US008385584B2

(12) United States Patent
Wang et al.

(10) Patent No.: US 8,385,584 B2
(45) Date of Patent: Feb. 26, 2013

(54) DIAPHRAGM AND LOUDSPEAKER USING THE SAME

(75) Inventors: Jia-Ping Wang, Beijing (CN); Liang Liu, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 260 days.

(21) Appl. No.: 12/824,412

(22) Filed: Jun. 28, 2010

(65) Prior Publication Data

US 2011/0116677 A1 May 19, 2011

(30) Foreign Application Priority Data

Nov. 17, 2009 (CN) ..... 2009 1 0109831

(51) Int. Cl.
*H04R 1/00* (2006.01)
*H04R 9/06* (2006.01)
*H04R 11/02* (2006.01)

(52) U.S. Cl. ..... 381/423; 977/742; 977/949

(58) Field of Classification Search ..... 977/742, 977/902, 949; 381/394, 413, 423–433
See application file for complete search history.

(56) References Cited

U.S. PATENT DOCUMENTS 4,312,118 A 1/1982 Saik et al.
6,597,798 B1 * 7/2003 Nakazono et al. ..... 381/410
6,639,993 B2 * 10/2003 Kemmerer et al. ..... 381/397
6,808,746 B1 10/2004 Dai et al.
7,045,108 B2 5/2006 Jiang et al.
7,437,938 B2 * 10/2008 Chakraborty ..... 73/714
8,068,626 B2 * 11/2011 Jiang et al. ..... 381/164
8,073,164 B2 * 12/2011 Jiang et al. ..... 381/164
2004/0020681 A1 2/2004 Hjortstam et al.
2004/0053780 A1 3/2004 Jiang et al.
2007/0166223 A1 7/2007 Jiang et al.
2008/0248235 A1 10/2008 Feng et al.
2008/0260188 A1 * 10/2008 Kim ..... 381/190
2008/0299031 A1 12/2008 Liu et al.
2008/0304694 A1 12/2008 Hayashi
2009/0045005 A1 * 2/2009 Byon et al. ..... 181/167
2009/0068448 A1 3/2009 Liu et al.
2009/0074228 A1 3/2009 Mango, III et al.

(Continued)

FOREIGN PATENT DOCUMENTS

CN 2282253 5/1998
CN 1270488 10/2000

(Continued)

OTHER PUBLICATIONS

"Flexible, Stretchable, Transparent Carbon Nanotube Thin Film Loudspeakers" Lin Xiao et al. Nano Letters, Oct. 29, 2008.*

(Continued)

*Primary Examiner* — Jeffrey Donels
(74) *Attorney, Agent, or Firm* — Altis Law Group, Inc.

(57) ABSTRACT

A diaphragm includes a central portion and an edge portion around the central portion. The central portion includes a plurality of carbon nanotubes therein. The central portion is a carbon nanotube structure or a carbon nanotube composite structure. A loudspeaker using the diaphragm is also disclosed. The loudspeaker includes the diaphragm and a voice coil connected to the diaphragm. The voice coil is connected to an outer periphery of the central portion or a joint portion between the central portion and the edge portion.

20 Claims, 12 Drawing Sheets

U.S. PATENT DOCUMENTS

| | | | | |
|---|---|---|---|---|
| 2009/0153502 | A1 | 6/2009 | Jiang et al. | |
| 2009/0155467 | A1 | 6/2009 | Wang et al. | |
| 2009/0160799 | A1 | 6/2009 | Jiang et al. | |
| 2009/0197082 | A1 | 8/2009 | Jiang et al. | |
| 2009/0220767 | A1 | 9/2009 | Schlögl et al. | |
| 2009/0268559 | A1 * | 10/2009 | Jiang et al. | 367/140 |
| 2009/0272935 | A1 | 11/2009 | Hata et al. | |
| 2009/0296528 | A1 * | 12/2009 | Jiang et al. | 367/140 |
| 2010/0046784 | A1 * | 2/2010 | Jiang et al. | 381/386 |
| 2010/0188934 | A1 * | 7/2010 | Qian et al. | 367/140 |

FOREIGN PATENT DOCUMENTS

| | | |
|---|---|---|
| CN | 2488247 | 4/2002 |
| CN | 1430785 | 7/2003 |
| CN | 2583909 | 10/2003 |
| CN | 1640923 | 7/2005 |
| CN | 101239712 | 8/2008 |
| CN | 101288336 | 10/2008 |
| CN | 101304945 | 11/2008 |
| CN | 101321410 | 12/2008 |
| CN | 101381071 | 3/2009 |
| CN | 101464759 | 6/2009 |
| CN | 101499328 | 8/2009 |
| JP | 60-27298 | 2/1985 |
| JP | 63-49991 | 12/1988 |
| JP | 7-138838 | 5/1995 |
| JP | 2002-171593 | 6/2002 |
| JP | 2002-542136 | 12/2002 |
| JP | 2003-319490 | 11/2003 |
| JP | 2004-32425 | 1/2004 |
| JP | 2004-107196 | 4/2004 |
| JP | 2006-147801 | 6/2006 |
| JP | 2007-182352 | 7/2007 |
| JP | 2007-290908 | 11/2007 |
| JP | 2009-144158 | 7/2009 |
| JP | 2009-146420 | 7/2009 |
| JP | 2009-184910 | 8/2009 |
| WO | WO2007015710 | 2/2007 |

OTHER PUBLICATIONS

"Nanotubes made of carbon find an unexpected use." The Economist, Nov. 20, 2008.*

"Hot nanotube sheets produce music on demand." New Scientist, Oct. 31, 2008.*

Xiao et al.,Flexible, Stretchable, Transparent Carbon Nanotube Thin Film Loudspeakers,Nanoletter, vol. 8; No. 12, 4539-4545.

* cited by examiner

DIAPHRAGM AND LOUDSPEAKER USING THE SAME

CROSS-REFERENCE TO RELATED APPLICATIONS

This application claims all benefits accruing under 35 U.S.C. §119 from China Patent Application No. 200910109831.1, filed on Nov. 11, 2009, in the China Intellectual Property Office, the disclosure of which is incorporated herein by reference.

BACKGROUND

1. Technical Field

The present disclosure relates to diaphragms and loudspeakers and, particularly, to a diaphragm based on carbon nanotubes and a loudspeaker using the same.

2. Description of Related Art

A loudspeaker is an acoustic device transforming received electric signals into sounds. There are different types of loudspeakers that can be categorized by their working principle, such as electro-dynamic loudspeakers, electromagnetic loudspeakers, electrostatic loudspeakers, and piezoelectric loudspeakers. Among the various types, the electro-dynamic loudspeakers have simple structures, good sound qualities, low costs, and are most widely used.

The electro-dynamic loudspeaker typically includes a diaphragm, a bobbin, a voice coil, a damper, a magnet, and a frame. The voice coil is an electrical conductor placed in the magnetic field of the magnet. By applying an electrical current to the voice coil, a mechanical vibration of the diaphragm is produced due to the interaction between the electromagnetic field produced by the voice coil and the magnetic field of the magnets, thus producing sound waves by kinetically pushing the air. The diaphragm reproduces sound pressure waves, corresponding to the input electric signals.

To evaluate the loudspeaker, sound volume is a decisive factor. The sound volume of the loudspeaker relates to the input power of the electric signals and the conversion efficiency of the energy. However, when the input power is increased to certain levels, the typical diaphragm could deform or even break, thereby causing audible distortion.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments.

Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
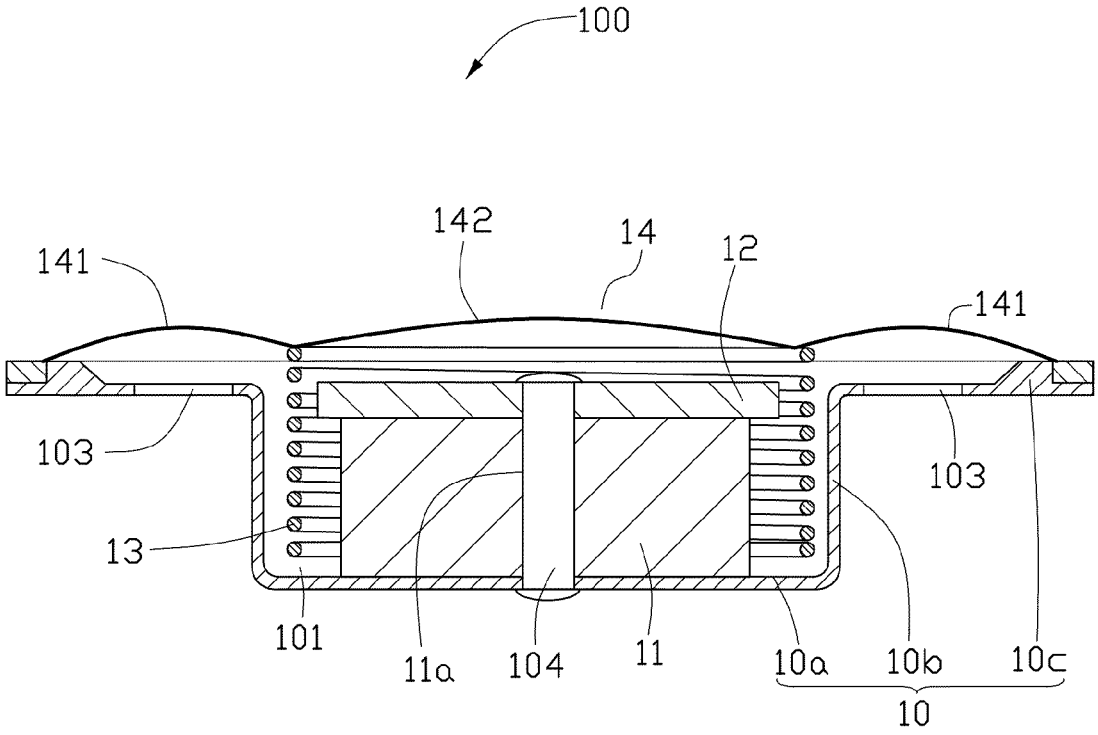
FIG. 1 is a schematic structural view of an embodiment of a loudspeaker.

Referring to FIG. 1, an embodiment of a loudspeaker 100 comprises a frame 10, a magnet 11, an installing plate 12, a voice coil 13 and a diaphragm 14.

The frame 10 can be made by pressing a round metal plate. The frame 10 comprises a bottom plate 10*a*, a sidewall 10*b* and a flange 10*c*. The sidewall 10*b* extends upwardly from a periphery of the bottom plate 10*a*. The sidewall 10*b* and the bottom plate 10*a* together define a chamber 101 having an opening opposite to the bottom plate 10*a*. The flange 10*c* extends outwardly substantially perpendicularly from a top periphery of the sidewall 10*b*. A plurality of vent holes 103 is defined through the flange 10*c* and facilitates air flowing in or out of the chamber 101. A pole 104 is vertically arranged in a center of the bottom plate 10*a*. The pole 104 can be used to install the magnet 11.

The magnet 11 has a ring shape and defines a hole 11*a* therethrough. The pole 104 can extend through the hole 11*a* so that the magnet 11 is installed on the pole 104. The outer diameter of the magnet 11 is smaller than the inner diameter of the chamber 101. The magnet 11 is positioned in the chamber 101 with a gap between the magnet 11 and the sidewall 10*b*. The thickness of the magnet 11 can be smaller than the length of the pole 104 so that the installing plate 12 can also be installed on the pole 104.

The installing plate 12 can be installed on a distal end of the pole 104 to retain the magnet 11 along the pole 104. The installing plate 12 can be made of impact absorbing materials to protect the magnet 11 from being damaged or destroyed. The outer diameter of the installing plate 12 is slightly larger than the outer diameter of the magnet 11. The installing plate 12, the bottom plate 10*a*, and the pole 104 cooperatively secure the magnet 11 in the chamber 101.

The voice coil 13 is a driving member of the loudspeaker 100 and positioned in the gap between the magnet 11 and the sidewall 10*b*. The voice coil 13 can be made of conducting wire. When the electric signal is input into the voice coil 13, a magnetic field can be formed by the voice coil 13 as the variation of the electric signal. The interaction of the magnetic field caused by the voice coil 13 and the magnet 13 produce the vibration of the voice coil 13. When the voice coil 13 vibrates, the diaphragm 14 also vibrates with the voice coil 13 to produce sound.

The diaphragm 14 is a sound producing member of the loudspeaker 100. The shape of the diaphragm 14 is not limited. The diaphragm 14 can be cut into other shapes, such as circular, elliptical, square, or rectangular, to adapt to actual needs of a desired loudspeaker design.

Figure 2:
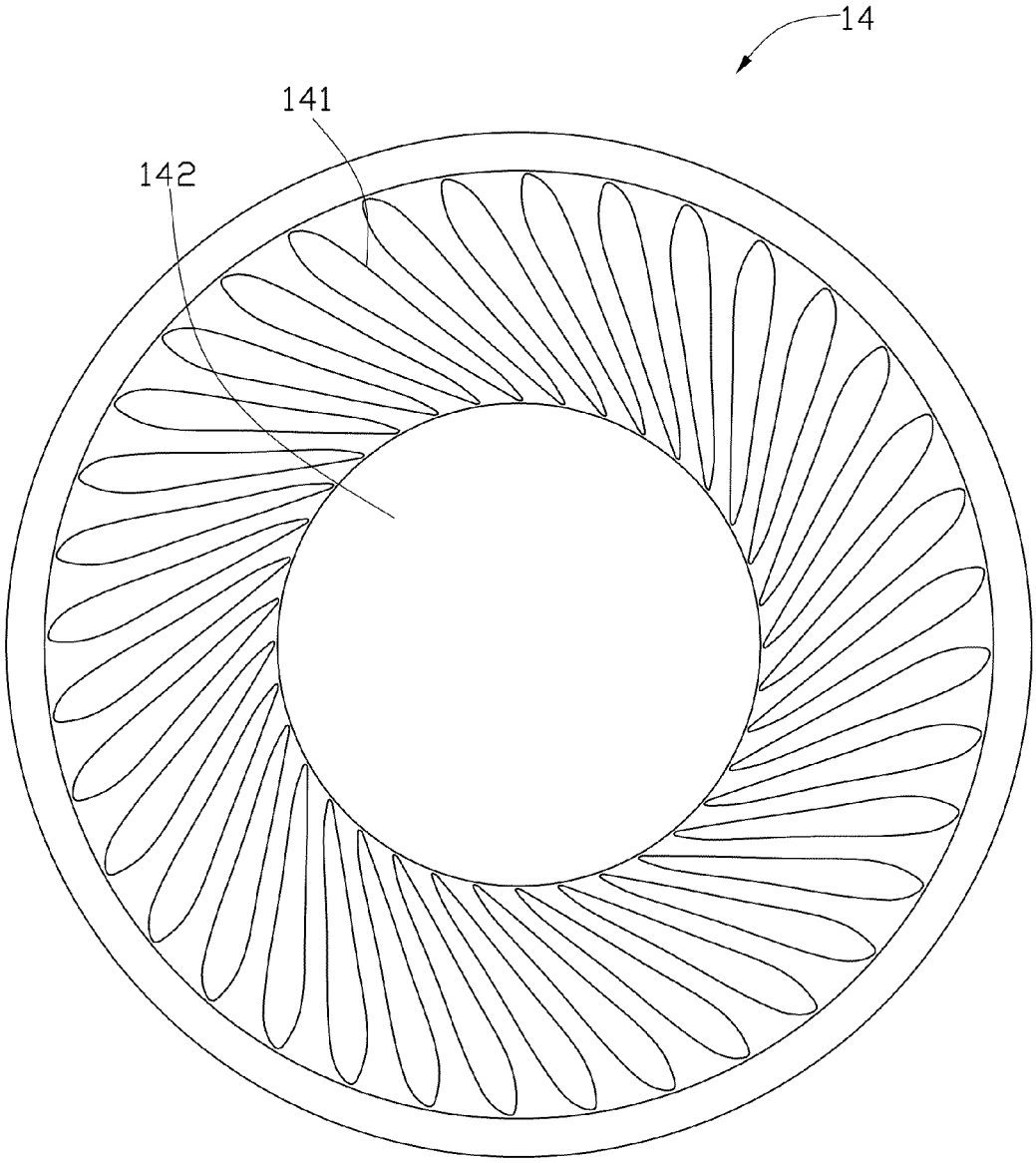
FIG. 2 is a schematic top view of a diaphragm of the loudspeaker of FIG. 1.
Figure 3:
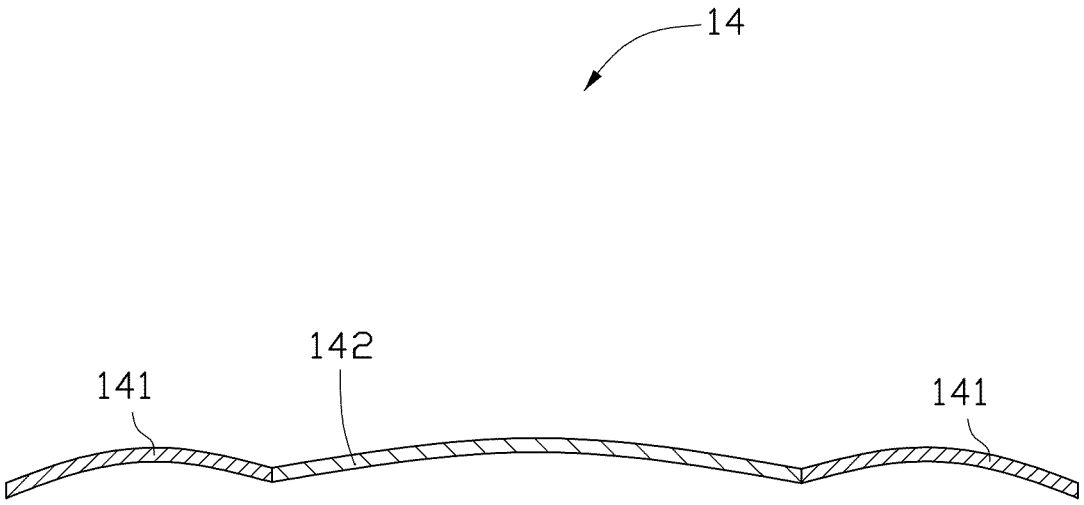
FIG. 3 is a cross-sectional view of the diaphragm of FIG. 2.

In the embodiment shown in FIGS. 2-3, the diaphragm 14 comprises a convex central portion 142 and a circular edge portion 141 around the central portion 142. The central portion 142 can be convex in the direction of sound emission. The edge portion 141 can also be convex in the direction of sound emission. An inner edge of the edge portion 141 is connected to an outer periphery of the central portion 142. An outer edge of the edge portion 141 is secured on the flange 10*c* so the diaphragm 14 is secured on the frame 10 with the central portion 142 covering the opening of the chamber 101. Further, the voice coil 13 can be connected to the outer periphery of the central portion 142 or a joint portion between the central portion 142 and the edge portion 141, so that the central portion 142 and the edge portion 141 can vibrate with the voice coil 13.

The edge portion 141 can be made of cloth, paper, paper-based wool, or polypropylene. The central portion 142 can be a layer of carbon nanotube composite structure which has a thickness of about 1 μm to about 1 mm. In one embodiment, the central portion 142 comprises a diaphragm matrix and a carbon nanotube structure composited with the diaphragm matrix. The carbon nanotube composite structure can be divided into several types according to the relationships of the diaphragm matrix and the carbon nanotube structure.

In one embodiment of the carbon nanotube composite structure, the material of the diaphragm matrix infiltrates into the carbon nanotube structure, thereby forming a carbon nanotube composite structure. In this embodiment of the carbon nanotube composite structure, the material of the diaphragm matrix can be polymer, such as polypropylene, polyacrylonitrile, bitumen, tenasco, phenolic fiber polyvinyl chloride, phenolic resin, epoxide resin, silica gel, or polyester.

In another embodiment of the carbon nanotube composite structure, the diaphragm matrix is a layer structure and the carbon nanotube structure is uniformly distributed in the layer-shaped diaphragm matrix. In this type of carbon nanotube composite structure, the material of the diaphragm matrix can be cloth, paper, or paper-based wool. The material of the diaphragm matrix can also be cellulose, polyethylene terephthalate (PET), cyrex, polyethylene, polypropylene, polystyrene, polyvinyl chloride, phenolic resin, epoxide resin, silica gel, or polyester.

In the embodiment shown in FIG. 3, the central portion 142 is a layer of carbon nanotube composite structure. The edge portion 141 can be made of cloth, paper, paper-based wool, or polypropylene. The edge portion 141 can be attached to the outer periphery of the central portion 142 via adhesives or other manners.

Figure 4:
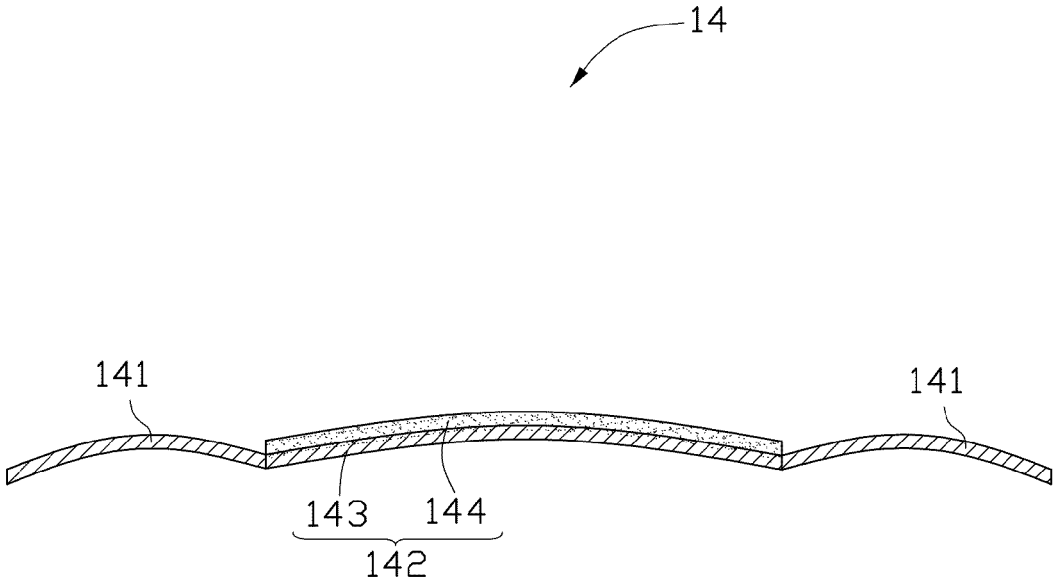
FIG. 4 is a cross-sectional view of an embodiment of a diaphragm which can be used in the loudspeaker of FIG. 1.

In the embodiment shown in FIG. 4, the central portion 142 comprises a diaphragm matrix 143 and a carbon nanotube structure 144. The carbon nanotube structure 144 can be disposed to a surface of the diaphragm matrix 143, and at least some parts of the diaphragm matrix 143 are infiltrated into the carbon nanotube structure 144, thereby forming a carbon nanotube composite structure.

The diaphragm matrix 143 and the edge portion 141 can be made of the same materials. The diaphragm matrix 143 and the edge portion 141 can be first formed from one piece of material. Then the carbon nanotube structure 144 can be disposed on the diaphragm matrix 143. Finally, at least some parts of the diaphragm matrix 143 are infiltrated into the carbon nanotube structure 144 after hot pressing treatment.

The carbon nanotube structure can include a plurality of carbon nanotubes distributed therein, and the carbon nanotubes therein can be combined by van der Waals attractive force therebetween. The carbon nanotubes in the carbon nanotube structure can be arranged orderly or disorderly. The term 'disordered carbon nanotube structure' includes, but is not limited to, a structure where the carbon nanotubes are arranged along many different directions, arranged such that the number of carbon nanotubes arranged along each different direction can be almost the same (e.g. uniformly disordered); and/or entangled with each other. 'Ordered carbon nanotube structure' includes, but not limited to, a structure where the carbon nanotubes are arranged in a systematic manner, e.g., the carbon nanotubes are arranged approximately along a same direction and or have two or more sections within each of which the carbon nanotubes are arranged approximately along a same direction (different sections can have different directions). The carbon nanotubes in the carbon nanotube structure can be single-walled, double-walled, and/or multi-walled carbon nanotubes. The diameters of the single-walled carbon nanotubes can range from about 0.5 nanometers to about 50 nanometers. The diameters of the double-walled carbon nanotubes can range from about 1 nanometer to about 50 nanometers. The diameters of the multi-walled carbon nanotubes can range from about 1.5 nanometers to about 50 nanometers. It is also understood that there may be many layers of ordered and/or disordered carbon nanotube films in the carbon nanotube structure.

In some embodiments, the carbon nanotube structure has a free standing structure and does not require the use of structural support. The term "free-standing" includes, but is not limited to, a structure that does not have to be supported by a substrate and can sustain the weight of itself when it is hoisted by a portion thereof without any significant damage to its structural integrity.

The carbon nanotube structure can comprise at least one carbon nanotube film, at least one linear carbon nanotube structure, and/or a combination thereof. If the carbon nanotube structure comprises a plurality of carbon nanotube films, the plurality of carbon nanotube films can be stacked together and/or coplanar arranged. If the carbon nanotube structure comprises a single linear carbon nanotube structure, the single linear carbon nanotube structure can be folded or coiled to form a layer-shape free standing structure. If the carbon nanotube structure comprises a plurality of linear carbon nanotube structures, the plurality of linear carbon nanotube structures can be substantially parallel with each other (not shown), crossed with each other, or woven together to obtain a layer-shape structure. If the carbon nanotube structure comprises a plurality of linear carbon nanotube structures and a plurality of carbon nanotube films, the plurality of linear carbon nanotube structures can be disposed on at least one surface of the plurality of carbon nanotube films.

It is noteworthy that, if the carbon nanotube structure comprises a plurality of linear carbon nanotube structures and a plurality of wires made of other materials, the plurality of linear carbon nanotube structures and the plurality of wires made of other materials can be crossed with each other or woven together. The other materials include cloth, paper, paper-based wool, and polypropylene. Some examples of the carbon nanotube structure are given below.

Drawn Carbon Nanotube Film

Figure 5:
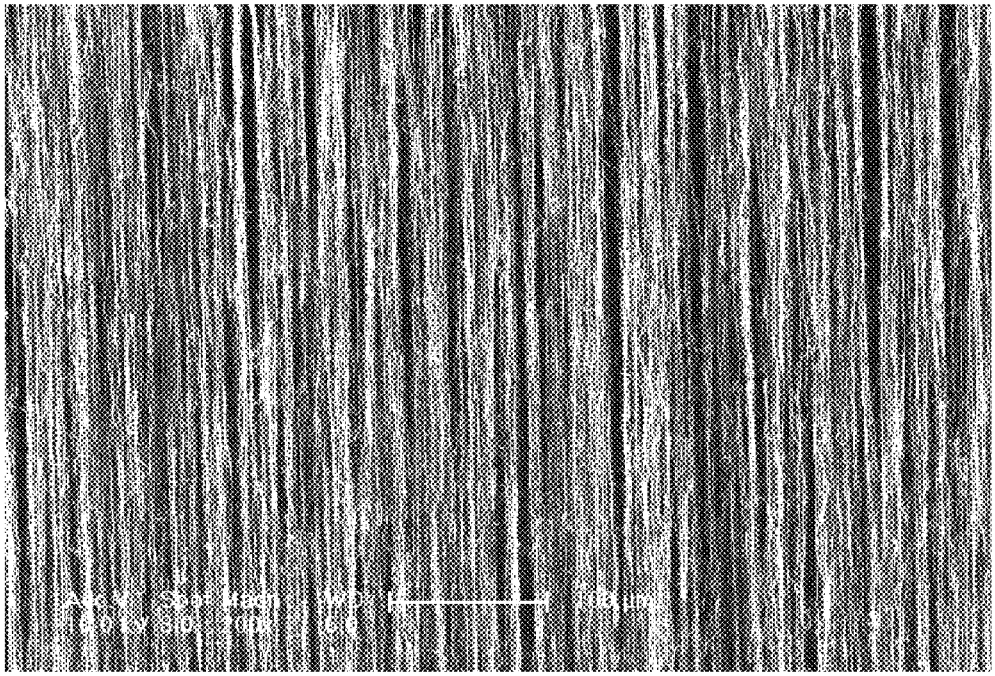
FIG. 5 shows a Scanning Electron Microscope (SEM) image of a drawn carbon nanotube film.
Figure 6:
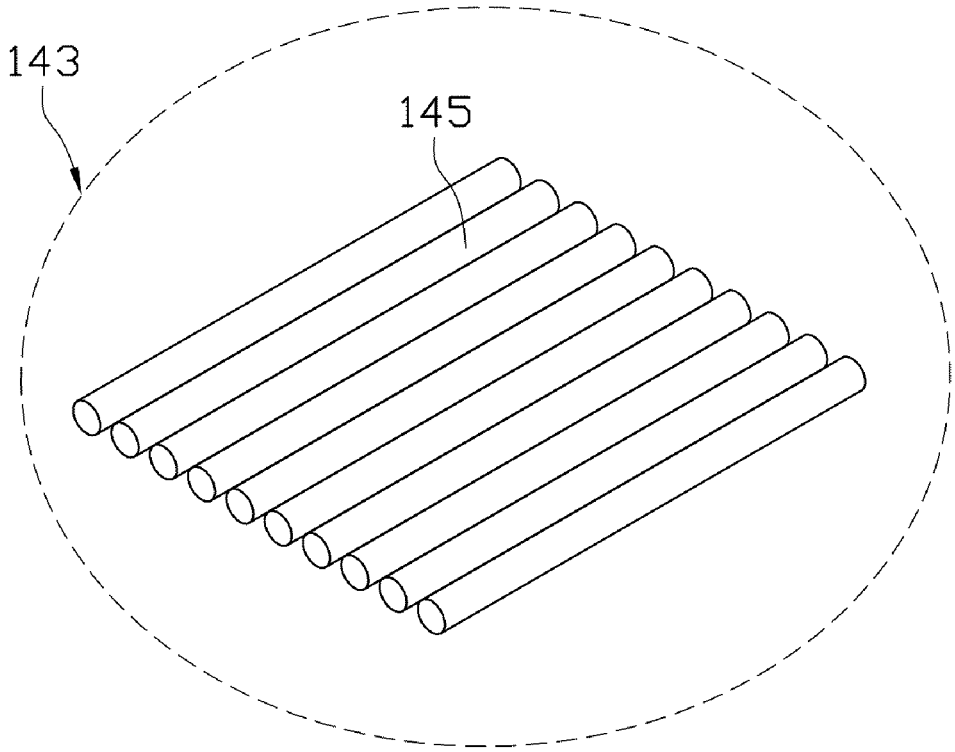
FIG. 6 is a schematic, enlarged view of a carbon nanotube segment in the drawn carbon nanotube film of FIG. 5.

In one embodiment, the carbon nanotube structure can include at least one drawn carbon nanotube film. Examples of a drawn carbon nanotube film are taught by U.S. Pat. No. 7,045,108 to Jiang et al., and WO 2007015710 to Zhang et al. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be formed by drawing a film from a carbon nanotube array capable of having a film drawn therefrom. Referring to FIGS. 5 and 6, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 substantially parallel to each other, and combined by van der Waals attractive force therebetween. As can be seen in FIG. 5, some variations can occur in the drawn carbon nanotube film. The carbon nanotubes 145 in the drawn carbon nanotube film are also oriented along a preferred orientation.

The carbon nanotube structure can also include at least two stacked drawn carbon nanotube films. In other embodiments, the carbon nanotube structure can include two or more coplanar drawn carbon nanotube films. Coplanar drawn carbon nanotube films can also be stacked upon other coplanar films. Additionally, an angle can exist between the orientation of carbon nanotubes in adjacent drawn films, stacked and/or coplanar. Adjacent drawn carbon nanotube films can be combined by only van der Waals attractive forces therebetween without the need of an additional adhesive. An angle between the aligned directions of the carbon nanotubes in the two adjacent drawn carbon nanotube films can range from about 0 degrees to about 90 degrees. If the angle between the aligned directions of the carbon nanotubes in adjacent drawn carbon nanotube films is larger than 0 degrees, a microporous structure is defined by the carbon nanotubes. The carbon nanotube structure in one embodiment employing these films will have a plurality of micropores. The sizes of the micropores can be less than 10 μm.

Flocculated Carbon Nanotube Film

Figure 7:
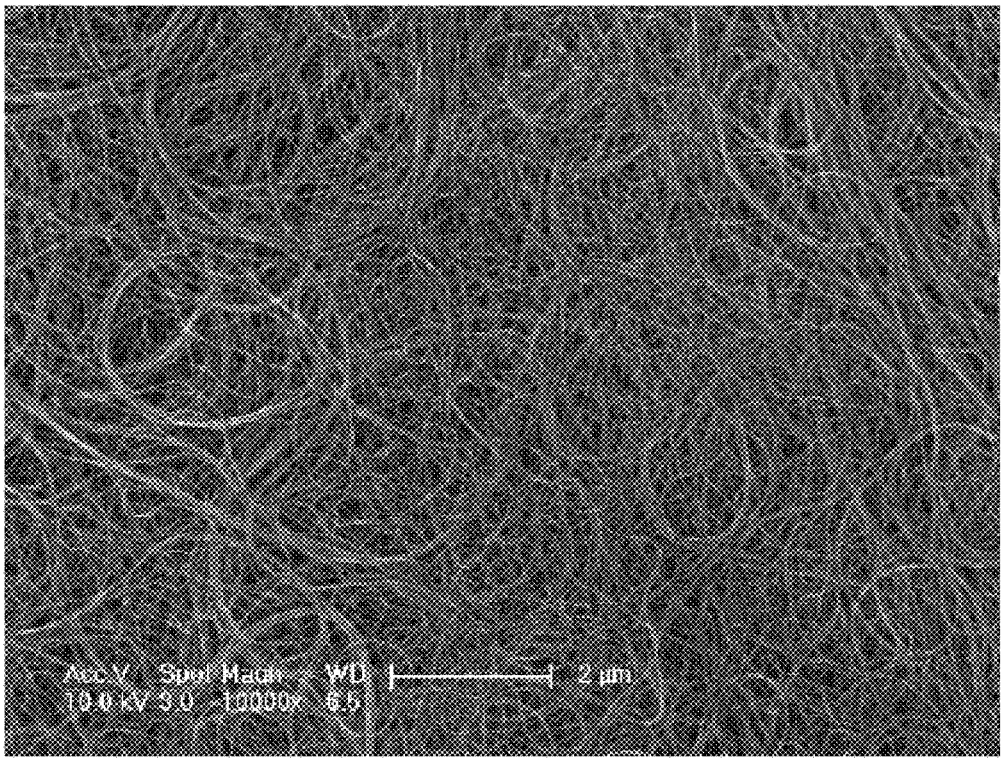
FIG. 7 is an SEM image of a flocculated carbon nanotube film.

In other embodiments, the carbon nanotube structure can include a flocculated carbon nanotube film. Referring to FIG. 7, the flocculated carbon nanotube film can include a plurality of long, curved, disordered carbon nanotubes entangled with each other. Further, the flocculated carbon nanotube film can be isotropic. The carbon nanotubes can be substantially uniformly dispersed in the carbon nanotube film. Adjacent carbon nanotubes are acted upon by van der Waals attractive force to obtain an entangled structure with micropores defined therein. It is understood that the flocculated carbon nanotube film is very porous. The sizes of the micropores can be less than 10 μm. The porous nature of the flocculated carbon nanotube film will increase the specific surface area of the carbon nanotube structure. Because the carbon nanotubes in the carbon nanotube structure are entangled with each other, the carbon nanotube structure employing the flocculated carbon nanotube film has excellent durability, and can be fashioned into desired shapes with a low risk to the integrity of the carbon nanotube structure. The thickness of the flocculated carbon nanotube film can range from about 1 μm to about 1 mm.

Pressed Carbon Nanotube Film

Figure 8:
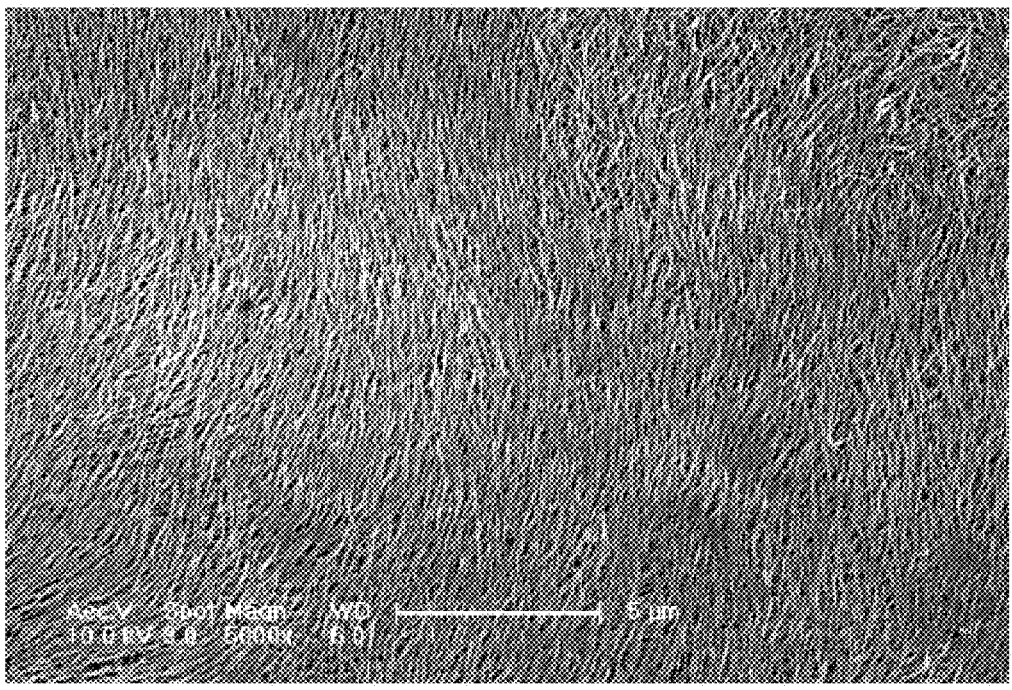
FIG. 8 is an SEM image of a pressed carbon nanotube film.

In other embodiments, the carbon nanotube structure can include at least a pressed carbon nanotube film. Referring to FIG. 8, the pressed carbon nanotube film can be a free-standing carbon nanotube film. The carbon nanotubes in the pressed carbon nanotube film can be arranged along a same direction or along different directions. The carbon nanotubes in the pressed carbon nanotube film can rest upon each other. Adjacent carbon nanotubes are attracted to each other and combined by van der Waals attractive force. An angle between a primary alignment direction of the carbon nanotubes and a surface of the pressed carbon nanotube film is about 0 degrees to approximately 15 degrees. The greater the pressure applied, the smaller the angle obtained. If the carbon nanotubes in the pressed carbon nanotube film are arranged along different directions, the carbon nanotube structure can be isotropic. Here, "isotropic" means the carbon nanotube film has properties identical in all directions substantially parallel to a surface of the carbon nanotube film. The thickness of the pressed carbon nanotube film can range from about 0.5 nm to about 1 mm. Examples of a pressed carbon nanotube film are taught by US PGPub. 20080299031A1 to Liu et al. Linear carbon nanotube structure In other embodiments, the carbon nanotube structure can include at least one linear carbon nanotube structure. The linear carbon nanotube structure can include one or more carbon nanotube wires. The carbon nanotube wires in the linear carbon nanotube structure can be substantially parallel to each other to form a bundle-like structure or twisted with each other to form a twisted structure.

Figure 9:
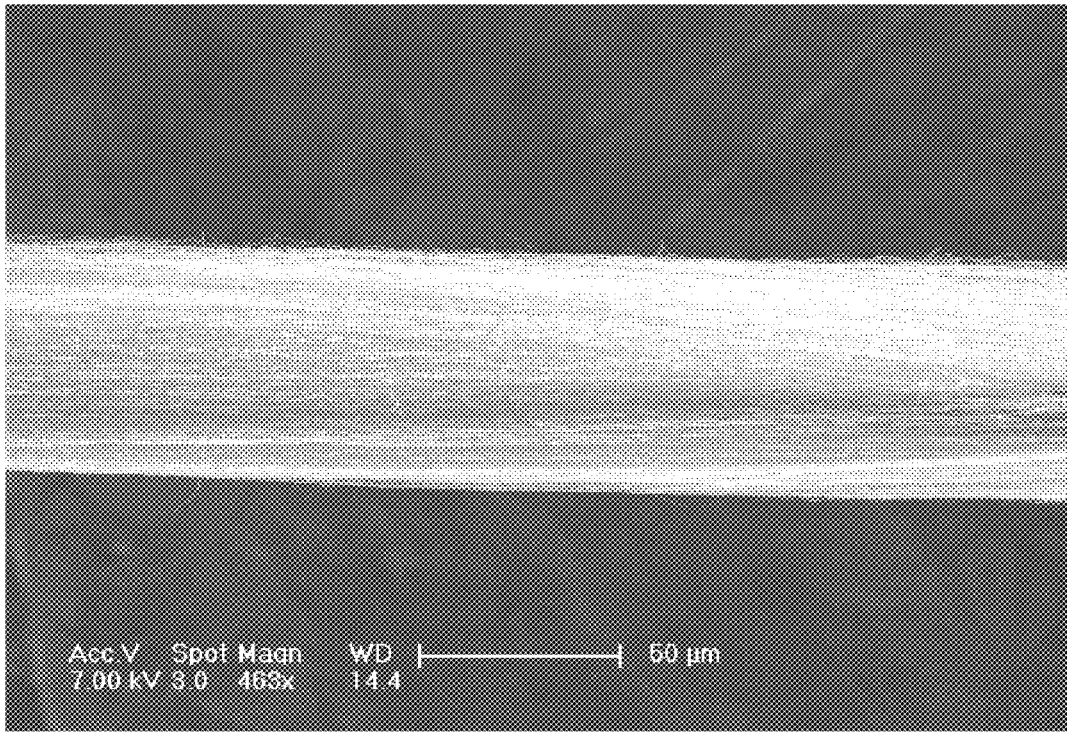
FIG. 9 is an SEM image of an untwisted carbon nanotube wire.

The carbon nanotube wire can be an untwisted carbon nanotube wire or a twisted carbon nanotube wire. An untwisted carbon nanotube wire is formed by treating a carbon nanotube film with an organic solvent. FIG. 9 shows an untwisted carbon nanotube wire and the untwisted carbon nanotube wire includes a plurality of successive carbon nanotubes, which are substantially oriented along the linear direction of the untwisted carbon nanotube wire and joined end-to-end by van der Waals attraction force therebetween. The untwisted carbon nanotube wire has a diameter ranging from about 0.5 nm to about 100 μm.

Figure 10:
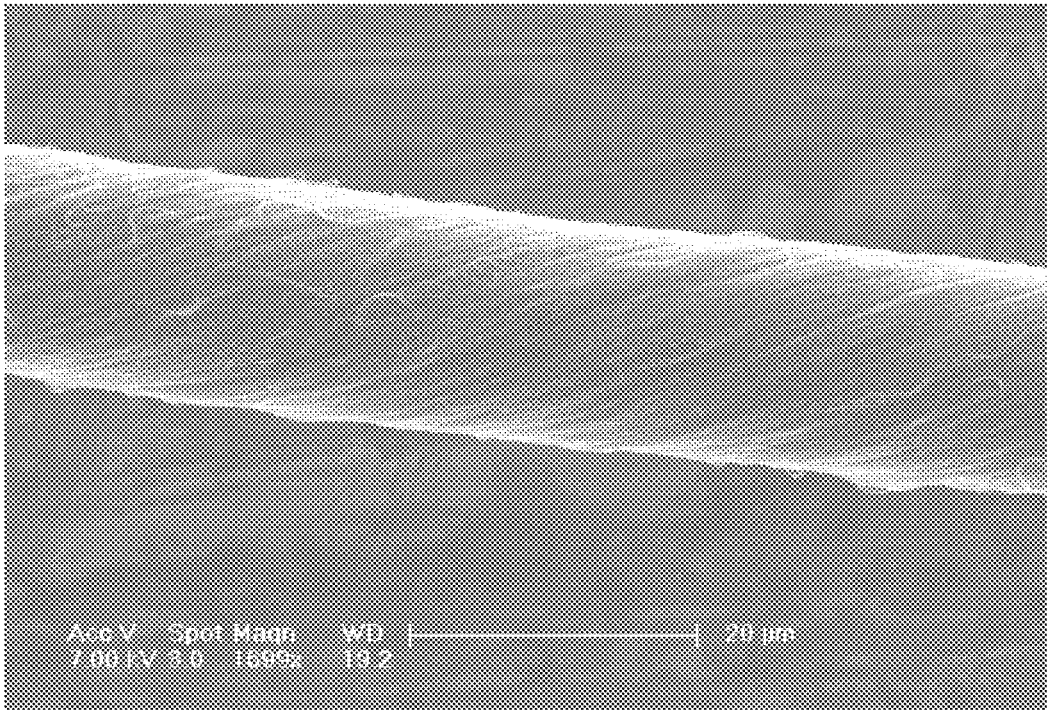
FIG. 10 is an SEM image of a twisted carbon nanotube wire.

A twisted carbon nanotube wire is formed by twisting a carbon nanotube film by using a mechanical force. FIG. 10 shows a twisted carbon nanotube wire and the twisted carbon nanotube wire includes a plurality of carbon nanotubes oriented around an axial direction of the twisted carbon nanotube wire. The length of the twisted carbon nanotube wire can be set as desired and the diameter of the carbon nanotube wire can range from about 0.5 nanometers to about 100 micrometers. The twisted carbon nanotube wire can be treated with an organic solvent before or after twisting.

Figure 11:
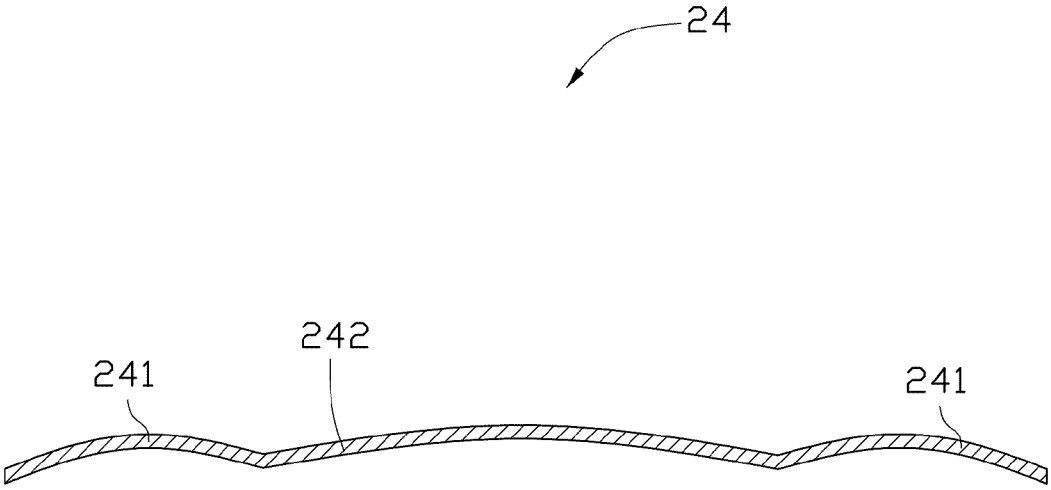
FIG. 11 is a cross-sectional view of another embodiment of a diaphragm.

FIG. 11 shows a cross-sectional view of another embodiment of a diaphragm 24 comprising a convex central portion 242 and a circular edge portion 241 around the central portion 242. The diaphragm 24 is similar to the diaphragm 14, except that the central portion 242 and the edge portion 241 are each a layer of carbon nanotube composite structure as described above. The central portion 242 and the edge portion 241 can be formed simultaneously.

Figure 12:
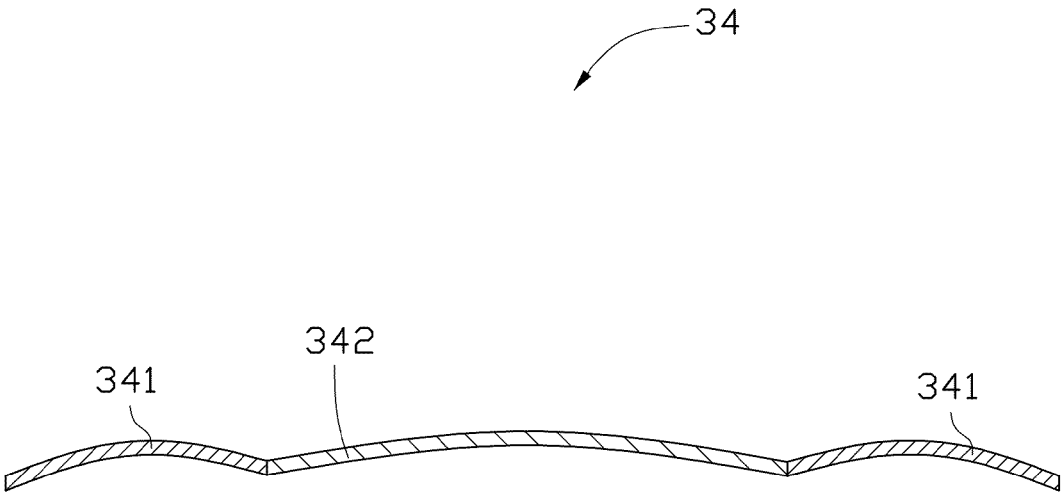
FIG. 12 is a cross-sectional view of yet another embodiment of a diaphragm.

FIG. 12 shows a cross-sectional view of another embodiment of a diaphragm 34 comprising a convex central portion 342 and a circular edge portion 341 around the central portion 342. The diaphragm 34 is similar to the diaphragm 14, except that the central portion 342 is a layer of carbon nanotube structure as described above. In one embodiment, the central portion 342 is a plurality of stacked carbon nanotube films. The thickness of the layer of the carbon nanotube structure can be in the range of about 1 μm to about 1 mm, but is not limited to this thickness.

According to above descriptions, the diaphragms of present disclosure have the following advantages.

(1) The carbon nanotube structure or carbon nanotube composite structure provided in the central portion can greatly increase the specific strength of the diaphragm due to the good mechanical properties of the carbon nanotube structure or carbon nanotube composite structure.

(2) The carbon nanotube structure or carbon nanotube composite structure provided in the central portion can decrease the weight of the diaphragm compared to a typical diaphragm under the same volume.

(3) The carbon nanotube structure or carbon nanotube composite structure provided in the central portion can increase the sound volume and the conversion efficiency of the energy.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A diaphragm comprising:

a central portion comprising a plurality of carbon nanotubes, wherein the plurality of carbon nanotubes is combined together to form a carbon nanotube structure, and the carbon nanotube structure is a free standing structure; and an edge portion around the central portion;

wherein at least one of the central portion and the edge portion is convex.

2. The diaphragm of claim 1, wherein the plurality of carbon nanotubes is combined together by van der Waals attractive force therebetween and forms at least one carbon nanotube film.

3. The diaphragm of claim 1, wherein the central portion further comprises a diaphragm matrix composited with the plurality of carbon nanotubes.

4. The diaphragm of claim 3, wherein the plurality of carbon nanotubes is uniformly distributed in the diaphragm matrix.

5. The diaphragm of claim 3, wherein the diaphragm matrix has a layer shape and the plurality of carbon nanotubes is combined together by van der Waals attractive force therebetween and form at least one layer shape carbon nanotube structure, the at least one layer shape carbon nanotube structure being stacked on the diaphragm matrix.

6. The diaphragm of claim 3, wherein the plurality of carbon nanotubes is combined together by van der Waals attractive force therebetween and forms a carbon nanotube structure, and at least part of the diaphragm matrix infiltrate into the carbon nanotube structure.

7. The diaphragm of claim 6, wherein the carbon nanotube structure comprises at least one carbon nanotube film, at least one linear carbon nanotube structure, or a combination of the at least one carbon nanotube film and the at least one linear carbon nanotube structure.

8. The diaphragm of claim 7, wherein the at least one carbon nanotube film is a drawn carbon nanotube film, a flocculated carbon nanotube film, or a pressed carbon nanotube film.

9. The diaphragm of claim 7, wherein the at least one linear carbon nanotube structure comprises a single carbon nanotube wire, the single carbon nanotube wire being folded or coiled to form a layer-shape free standing structure.

10. The diaphragm of claim 7, wherein the at least one linear carbon nanotube structure comprises a plurality of carbon nanotube wires substantially parallel to each other, or a plurality of carbon nanotube wires twisted together.

11. The diaphragm of claim 7, wherein the carbon nanotube structure comprises a combination of the at least one carbon nanotube film and the at least one linear carbon nanotube structure, the at least one linear carbon nanotube structure being arranged on a surface of the at least one carbon nanotube film.

12. The diaphragm of claim 3, wherein the diaphragm matrix and the edge portion are made of the same materials.

13. The diaphragm of claim 3, wherein both the central portion and the edge portion are a layer of carbon nanotube composite structure.

14. A loudspeaker comprising:

a diaphragm comprising a central portion and an edge portion around the central portion, the central portion comprising a plurality of carbon nanotubes, wherein the plurality of carbon nanotubes is combined together by van der Waals attractive force to form a carbon nanotube structure; and a voice coil connected to the diaphragm.

15. The loudspeaker of claim 14, wherein the edge portion extends from an outer periphery of the central portion, and the voice coil is connected to the outer periphery of the central portion or a joint portion between the central portion and the edge portion.

16. The loudspeaker of claim 14, wherein the central portion is a carbon nanotube structure or a carbon nanotube composite structure.

17. The loudspeaker of claim 14, wherein the central portion further comprises a diaphragm matrix composited with the plurality of carbon nanotubes.

18. The loudspeaker of claim 17, wherein the diaphragm matrix and the edge portion are made of the same materials.

19. The loudspeaker of claim 17, wherein the edge portion comprises a plurality of carbon nanotubes and a diaphragm matrix composited with the plurality of carbon nanotubes of the edge portion; the diaphragm matrix of the edge portion and the diaphragm matrix of the central portion are made of the same material.

20. The loudspeaker of claim 14, wherein at least one of the central portion and the edge portion is convex with a transitional portion formed between the central portion and the edge portion, and the voice coil connected to the transitional portion.

* * * * *